US007347738B2

(12) United States Patent
Hsieh et al.

(10) Patent No.: US 7,347,738 B2
(45) Date of Patent: Mar. 25, 2008

(54) LOW PROFILE ELECTRICAL CONNECTOR ASSEMBLY AND TERMINAL THEREFOR

(75) Inventors: Shao Chung Hsieh, Warren, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/403,270

(22) Filed: Apr. 13, 2006

(65) Prior Publication Data

US 2007/0243770 A1 Oct. 18, 2007

(51) Int. Cl.
*H01R 13/502* (2006.01)

(52) U.S. Cl. ..... 439/687; 439/874; 439/752; 439/867

(58) Field of Classification Search ..... 439/687, 439/689, 874, 752, 867, 731, 701, 442, 884, 439/885
See application file for complete search history.

(56) References Cited

U.S. PATENT DOCUMENTS

| | | | | | |
|---|---|---|---|---|---|
| 4,767,361 | A * | 8/1988 | Hoshino et al. | ..... | 439/596 |
| 4,784,623 | A * | 11/1988 | Beck, Jr. | ..... | 439/872 |
| 4,840,578 | A * | 6/1989 | Sato | ..... | 439/395 |
| 4,863,400 | A * | 9/1989 | Sato | ..... | 439/595 |
| 5,228,874 | A * | 7/1993 | Lin | ..... | 439/687 |
| 5,611,717 | A * | 3/1997 | Joly | ..... | 439/857 |
| 6,083,060 | A * | 7/2000 | Chen et al. | ..... | 439/885 |
| 6,113,438 | A * | 9/2000 | O'Sullivan | ..... | 439/740 |
| 6,183,309 | B1 * | 2/2001 | Chiang | ..... | 439/687 |
| 6,450,831 | B2 * | 9/2002 | Aoyama et al. | ..... | 439/399 |
| 6,588,646 | B2 | 7/2003 | Loprire | | |
| 6,695,628 | B2 * | 2/2004 | Yeh | ..... | 439/83 |
| 6,764,357 | B2 * | 7/2004 | Wu et al. | ..... | 439/885 |
| 6,811,450 | B1 * | 11/2004 | Data et al. | ..... | 439/748 |
| 6,837,751 | B2 * | 1/2005 | Vanden Wymelenberg et al. | ..... | 439/701 |
| 6,846,200 | B1 * | 1/2005 | Hsu | ..... | 439/540.1 |
| 6,863,572 | B1 * | 3/2005 | Yi et al. | ..... | 439/637 |
| 7,025,617 | B2 * | 4/2006 | Regnier et al. | ..... | 439/329 |
| 7,048,567 | B2 * | 5/2006 | Regnier et al. | ..... | 439/329 |
| 7,077,708 | B1 * | 7/2006 | Johnson et al. | ..... | 439/687 |
| 2006/0009080 | A1 * | 1/2006 | Regnier et al. | ..... | 439/637 |

* cited by examiner

*Primary Examiner*—Renee Luebke
*Assistant Examiner*—Harshad C Patel
(74) *Attorney, Agent, or Firm*—David P. Wood

(57) ABSTRACT

A low profile electrical connector assembly has terminals attached to insulated electric cables that are disposed in topless slots of a connector base. Each terminal has two longitudinally spaced retention slots. The connector base has two transverse grooves that extend through sidewalls of the topless slots to provide terminal retainers that engage the forward retention slots to retain the terminals in a longitudinal direction. The connector base has a third transverse groove that extends through the sidewalls of the topless slots with selected sidewalls having undercuts for retaining a bottomless connector cover. The connector cover has a face plate that has a plurality of apertures that align with the topless slots, a lower ledge, and a depending lock bar. The lock bar is disposed in the third transverse groove and extends through the rearward retention slots to further retain the terminals in the longitudinal direction. The depending lock bar has a lip engaging the undercuts and the lower ledge of the cover is located in a bottom face groove of the connector base to hold the connector cover down on the topless slots. The connector cover is held in an assembled position by engaging portions of the face plate and the connector base.

12 Claims, 2 Drawing Sheets

LOW PROFILE ELECTRICAL CONNECTOR ASSEMBLY AND TERMINAL THEREFOR

FIELD OF THE INVENTION

This invention relates to an electrical connector assembly and a terminal for the electrical connector assembly.

BACKGROUND OF THE INVENTION

U.S. Pat. No. 6,837,751 granted to Vanden Wymelenberg, et al., Jan. 4, 2005, discloses an electrical connector assembly that has a plurality of insulated electric cables that are attached to a plurality of terminals. Each electric cable is ultrasonically welded to a weld pad of one terminal and clamped by an insulation crimp barrel of the terminal. The terminals and end portions of the electric cables are seated in slots of a terminal carrier to isolate the terminals from each other. The terminals are retained in the terminal slots by flexible lock arms of the terminal carrier. The terminal carrier is disposed in a connector housing that has an open side for sliding the carrier laterally into the connector housing. The open side of the connector housing is closed by a slide.

While the electrical connector assembly disclosed in the Vanden Wymelenberg '751 patent is useful for its intended purpose, there is a practical limit to miniaturization, particularly with respect to height and width reduction of the electrical connector assembly.

SUMMARY OF THE INVENTION

This invention provides an improved electrical connector assembly of the type disclosed in the Vanden Wymelenberg '751 patent that is characterized by a low profile.

In this aspect, the invention provides an electrical connector assembly comprising a connector base and a plurality of terminals that are attached to the respective ends of a plurality of insulated electric cables, the terminals and the ends of the insulated electric cables being disposed in topless slots of the connector base that are closed by a bottomless connector cover. Each of the terminals has a contact at one end, a medial portion having a retention slot, and an attachment portion at an opposite end. Each of the terminals is attached electrically and mechanically to one of the electric cables. Each electric cable has a conductive core that is attached to the respective terminal and an outer insulation jacket that is tightly gripped by the attachment portion of the respective terminal. The connector base has a transverse groove that extends through the sidewalls of the topless slots with selected ones on the sidewalls having undercuts for retaining the bottomless connector cover. The bottomless connector cover has a depending lock bar. The lock bar is disposed in the transverse groove and extends through the retention slots of the terminals to retain the terminals in the longitudinal direction. The depending lock bar has a lip cooperating with the undercuts of the connector base to hold the connector cover down on the topless slots.

The bottomless connector cover preferably has a face plate that has a plurality of apertures that align with respective ones of the topless slots, and a lower ledge. The optional lower ledge of the cover cooperates with a bottom face groove of the connector base to assist the hold down as well as maintain alignment of the apertures with the topless slots of the connector base. The connector cover is held in an assembled position by engaging portions of the face plate and the connector cover.

The medial portion of each of the terminals may also have an additional forward retention slot, in which case the connector base may have two additional forward, longitudinally spaced transverse grooves that extend through sidewalls of the topless slots to provide terminal retainers that also engage the forward retention slots to retain the terminals in the topless slots in a longitudinal direction.

In another aspect, the invention provides a terminal for a low profile electrical connector terminal assembly, having a contact at one end, a medial portion having two longitudinally spaced retention slots, and an attachment portion at an opposite end. The attachment portion may be thinner than the contact and the medial portion of the terminal to reduce the width of the resulting sub-assembly when the terminal is attached to an insulated electric cable by an ultrasonic welding technique. The reduced width of the sub-assembly in turn reduces the width of the electrical connector assembly or in other words increases terminal density.

DETAILED DESCRIPTION OF DETAILED EMBODIMENT

Figure 1:
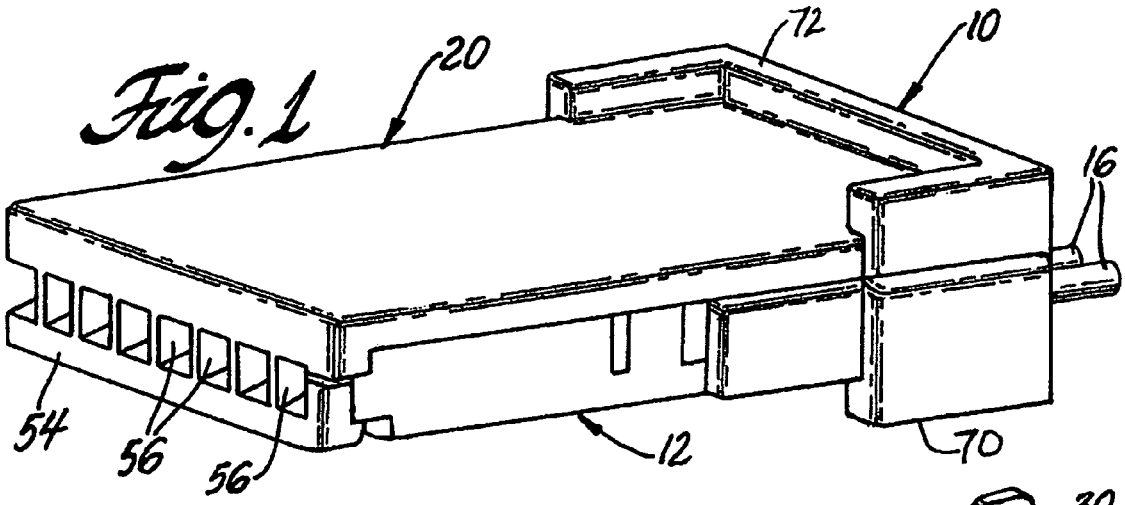
FIG. 1 is a perspective view of an electrical connector assembly of the invention.

Referring now to the drawings, an electrical connector assembly 10, comprises a connector base 12 and a plurality of terminals 14 that are attached to the respective ends of a plurality of insulated electric cables 16. The terminals 14 and the ends of the electric cables 16 are disposed in topless terminal slots 18 in connector base 12. The topless slots 18 are covered by a connector cover 20 that is attached to connector base 12.

Figure 2:
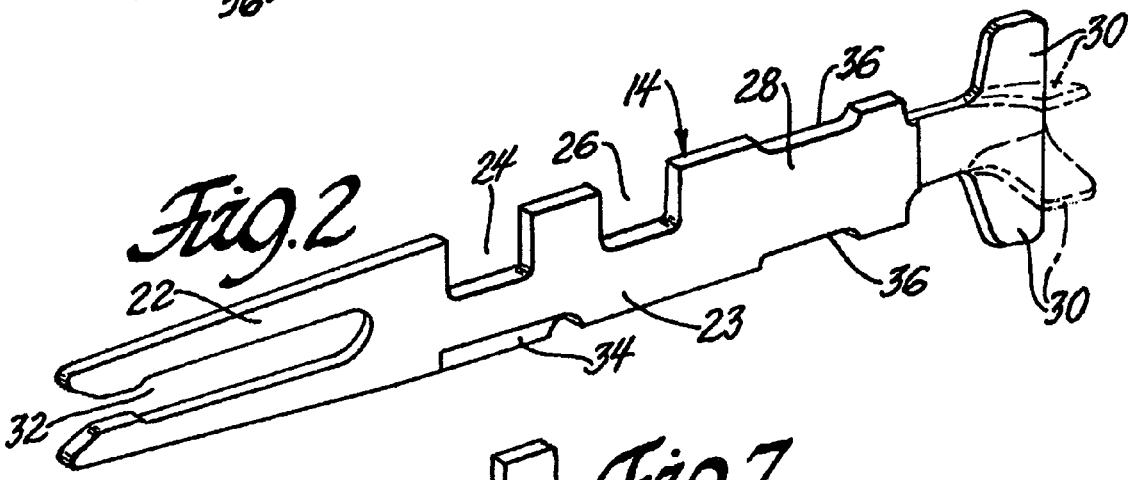
FIG. 2 is a perspective view of a terminal for the electrical connector assembly of FIG. 1.

Referring now to FIG. 2, which is a perspective view of a typical terminal 14 for the electrical connector assembly 10 of FIG. 1, the terminal 14 is stamped from sheet metal resulting in a substantially co-planar terminal that has a contact blade 22 at one end, a medial portion 23 (having two longitudinally spaced retention slots 24 and 26 and a weld pad 28), and an attachment portion 30 at an opposite end. Contact blade 22 is shaped like a "tuning fork" that has a slot 32 designed to receive a square pin of a mating terminal (not shown).

Medial portion 23 has a bottom edge below the forward retention slot 24 that preferably has a chamfer or lead-in 34 for inserting terminal 14 vertically into one of the topless slots 18 of connector base 12. Medial portion 23 also preferably has shallow upper and lower recesses 36 at weld pad 28 for locating insulated electric cable 16 when terminal 14 is attached to an end portion of one of the electric cables 16 by an ultrasonic welding technique such as that disclosed in the U.S. Pat. No. 6,588,646 granted to Nick M. Loprire Jul. 8, 2003. Attachment portion 30 is initially co-planar as shown in solid line in FIG. 2 and preferably thinner than the contact blade 22 and the medial portion 23 of terminal 14, the attachment portion 30 being reduced by as much as 50% in thickness to reduce space requirements in the connector base 12. Attachment portion 30 is usually formed into an open crimp barrel (as shown in phantom in FIG. 2) before terminal 14 is attached to insulated electric cable 16 as shown in FIG. 3.

Figure 3:
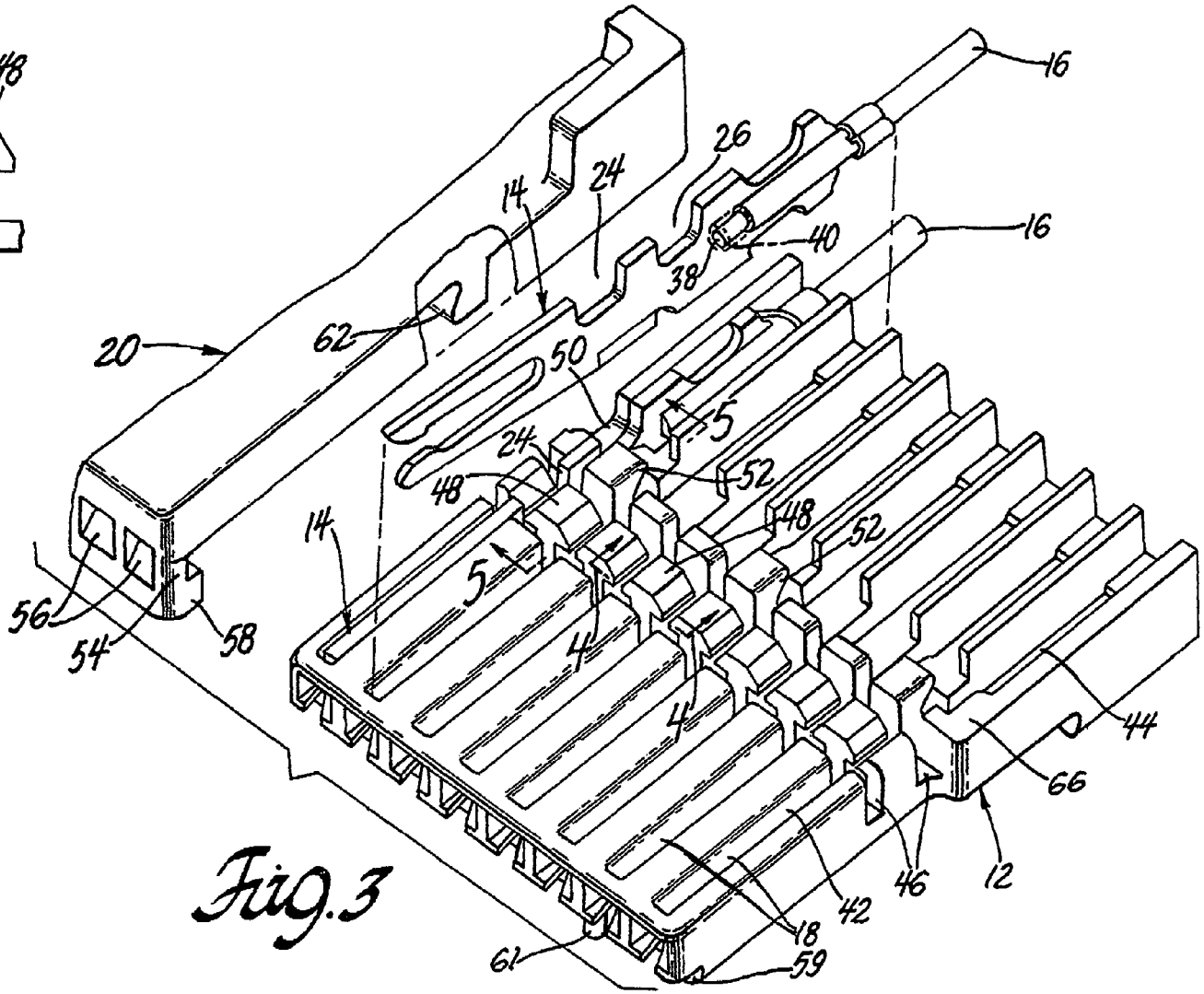
FIG. 3 is a partial exploded perspective view of the electrical connector assembly of FIG. 1.

FIG. 3 is an exploded perspective view of the electrical connector assembly 10 of FIG. 1 comprising connector base 12, terminals 14 attached to insulated electric cables 16, and connector cover 20. The typical terminal 14 is attached electrically and mechanically to a typical insulated electric cable 16, which comprises a conductive core 38 and an outer insulation jacket 40, by ultrasonically welding an end portion of the insulated electric cable 16 to weld pad 28 and crimping the open crimp barrel of attachment portion 30 of terminal 14 (shown in phantom in FIG. 2) tightly around insulation jacket 40.

End portion of electric cable 16 is welded to weld pad 28 so that conductive core 38 contacts weld pad 28 for establishing an electrical connection between the insulated electric cable 16 and terminal 14. End portion is preferably welded to weld pad 28 without stripping insulation jacket 40. Such a process is known from U.S. Pat. No. 6,588,646 to Loprire and from U.S. Pat. No. 6,837,751 to Vanden Wymelenberg, et al. discussed above, which discloses an electrical connector that has a plurality of insulated electric cables that are ultrasonically welded to welding pads of respective terminals and clamped by insulation crimp barrels. When attachment portion 30 is thinner and the end portion of electric cable 16 is welded to weld pad 28 without stripping insulation jacket 40, the resulting sub-assembly of FIG. 3 is reduced in width, that is, the resulting sub-assembly of FIG. 3 is narrower.

Figure 4:
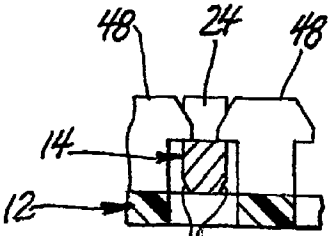
FIG. 4 is a section taken substantially along the line 4-4 of FIG. 3 looking in the direction of the arrows.

As indicated above, connector base 12 has a plurality of parallel, laterally spaced topless slots 18 for receiving the terminals 14 individually and isolating each terminal from the other terminals. Each topless slot 18 has a narrow forward contact receiving portion 42 that communicates with a wider rearward terminal and cable receiving portion 44. The width of the rearward terminal and cable receiving portion 44 can be reduced when attachment portion 30 is thinner and the end portion of electric cable 16 is welded to weld pad 28 without stripping insulation jacket 40, thereby reducing the width of connector assembly 10. Connector base 12 has two longitudinally spaced transverse grooves 46 that extend through the sidewalls of the topless narrow portions 42 to form flexible retainers 48 at each side of each narrow portion 42 of the respective topless slots 18 as best seen in FIGS. 3 and 4. Connector base 12 also has a third transverse groove 50 that intersects topless slots 18, preferably at the forward end of the wider terminal and cable receiving portions 44 where transverse groove 50 extends through side walls of the wider terminal and cable receiving portions 44. The bottom wall of connector base 12 has holes aligned with the spaces between retainers 48 to provide overhangs for retainers 48 (FIG. 4) and more holes aligned with transverse groove 50 to provide undercuts 52 (FIG. 5) for retaining and positioning a lock bar of connector cover 20.

Figure 6:
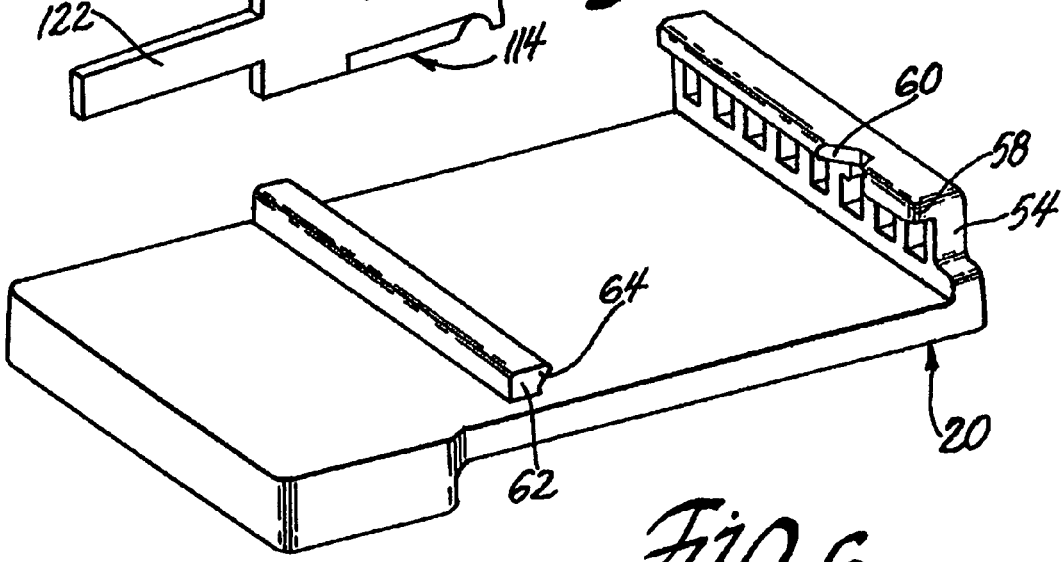
FIG. 6 is a perspective view of the connector cover for the electrical connector assembly of FIG. 1.

FIG. 6 is a perspective view of the bottomless connector cover 20 when it is flipped over from the upright position of FIGS. 1 and 3 to show details of the underside. The bottomless connector cover 20 has a face plate or flange 54 that has a plurality of apertures 56. Apertures 56 align with the respective narrow contact receiving portions 42 of terminal slots 18 when cover 20 is attached to connector base 12 to guide square male pins or the like into slots 32 of the terminals 14 located in the terminal slots 18.

Figure 5:
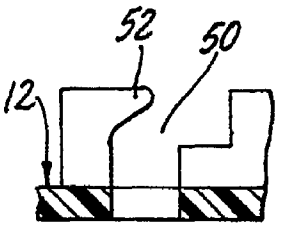
FIG. 5 is a section taken substantially along the line 5-5 of FIG. 3 looking in the direction of the arrows.

Face plate 54 has a lower ledge 58 that cooperates with a bottom face groove 59 of connector base 12. Ledge 58 includes a lock notch 60 that cooperates with a lock nib 61 of connector base 12. As indicated above, connector cover 20 has a depending lock bar 62. Lock bar 62 has a lip 64 that cooperates with undercuts 52 of connector base 12 to locate the lock bar 62 in the electrical connector assembly 10 as best shown in FIGS. 3, 5 and 6.

Electrical connector assembly 10 is assembled in the following manner. Terminals 14 are attached to insulated electric cables 16 as best shown in FIG. 3. Terminals 14 and the attached portions of electrical cables 16 are then inserted vertically into the respective topless terminals slots 18 of connector base 12. During insertion, chamfer 34 spreads the flexible retainers 48 on each side of the topless terminal slots 18 apart. When terminal 14 bottoms out in terminal slot 18, the flexible retainers 48 snap back into forward retention slot 24 in the medial portion of the terminal 14 to hold terminal 14 down and locate the terminal 14 in the longitudinal direction. When properly located, the rearward retention slot 26 in the medial portion of the terminal 14 is aligned with groove 50 of the connector base 12 as shown in FIG. 3.

When connector base 12 is filled with the desired number of terminals 14, the bottomless cover 20 is slid onto connector base 12 laterally. During assembly, lock bar 62 slides into the third groove 50 and through the rearward retention slots 26 of terminals 14 until lock bar 62 engages a stop wall 66 of connector base 12. During insertion, lip 64 slides under undercuts 52 while ledge 58 slides into the bottom face groove 59 of connector base 12. This cooperating structure serves as a means to hold cover 12 down on top of the topless terminal slots 18. Connector cover 20 is held in the assembled position shown by lock notch 60 engaging lock nib 61.

Connector base 12 may have an external, preferably U-shaped flange 70 at the rearward end while connector cover 20 may also have an external, preferably matching U-shaped flange 72 at the rearward end to provide a finger-thumb grip arrangement that facilitates plugging and unplugging of the electrical connector assembly 10.

Figure 7:
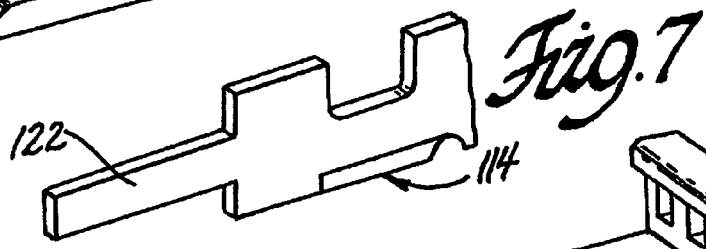
FIG. 7 is a partial perspective view of an alternate terminal for the electrical connector assembly of FIG. 1.

Terminal 14 is illustrated as having a contact blade 22 at one end that is shaped like a "tuning fork" that has a slot 32 designed to receive a square pin of a mating terminal (not shown). Alternatively, contact blade may be a solid blade or a square pin designed to mate with a complimentary female terminal, such as the terminal 114 shown in FIG. 7 that has a solid contact blade 122.

The topless terminal slots 18 of the connector base 12 and the bottomless connector cover 20 results in a low profile electrical connector assembly. Moreover, for further miniaturization, the width of the electrical connector assembly 10 can be reduced when the end portions of electric cables 16 are welded to weld pads 28 of the terminals 14 without stripping insulation jackets 40 and the terminals 14 have thinner attachment portions 30 gripping the insulation jackets 40.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A low profile electrical connector assembly comprising:

a connector base and a plurality of terminals that are attached to the respective ends of a plurality of insulated electric cables, the terminals and the ends of the insulated electric cables being disposed in topless slots of the connector base that are closed by a bottomless connector cover that is attached to the connector base, each of the terminals having a contact at one end, a medial portion having a retention slot, and an attachment portion at an opposite end, the connector base having a transverse groove that extends through sidewalls of the topless slots with selected ones of the sidewalls having undercuts for retaining the bottomless connector cover, the bottomless connector cover having a depending lock bar disposed in the transverse groove and extending through the retention slots to retain the terminals in a longitudinal direction, and the depending lock bar having a lip cooperating with the undercuts of the connector base and a lower ledge of the cover cooperating with a bottom face groove of the connector base to hold the connector cover down on the topless slots.

2. The low profile electrical connector assembly of claim 1 wherein the bottomless connector cover has a face plate that has a plurality of apertures that align with respective ones of the topless slots, the connector cover being held in an assembled position by engaging portions of the face plate and the connector base.

3. The low profile electrical connector assembly of claim 1 wherein the medial portion of each of the terminals has a forward retention slot, and the connector base has two longitudinally spaced transverse grooves that extend through sidewalls of the topless slots to provide terminal retainers that engage the forward retention slots of the terminals to retain the terminals in the topless slots in the longitudinal direction.

4. The low profile electrical connector assembly of claim 1 wherein the connector base has an external U-shaped flange at a rearward end of the connector base, and wherein the connector cover has an external U-shaped flange at a rearward end of the connector cover to provide a finger-thumb grip arrangement that facilitates plugging and unplugging of the electrical connector assembly.

5. A low profile electrical connector assembly comprising:

a connector base and a plurality of terminals that are attached to the respective ends of a plurality of insulated electric cables, the terminals and the ends of the insulated electric cables being disposed in topless slots of the connector base that are closed by a bottomless connector cover that is attached to the connector base, each of the terminals having a contact at one end, a medial portion having two longitudinally spaced retention slots, and an attachment portion at an opposite end, each of the terminals being attached electrically and mechanically to one of the electric cables that has a conductive core that is attached the respective terminal, and an outer insulation jacket that is tightly gripped by the attachment portion of the respective terminal, the connector base having two longitudinally spaced transverse grooves that extend through sidewalls of the topless slots to provide terminal retainers that engage forward ones of the retention slots of the terminals to retain the terminals in the topless slots in a longitudinal direction, the connector base having a third transverse groove that extends through the sidewalls of the topless slots with selected ones on the sidewalls having undercuts for retaining the bottomless connector cover, the bottomless connector cover having a face plate that has a plurality of apertures that align with respective ones of the topless slots, and a lower ledge that cooperates with a bottom face groove of the connector base, and the bottomless connector cover having a depending lock bar disposed in the third transverse groove and extending through the rearward retention slots to further retain the terminals in the longitudinal direction, the depending lock bar having a lip cooperating with the undercuts of the connector base and the lower ledge of the cover cooperating with the bottom face groove of the connector base to hold the connector cover down on the topless slots, and the connector cover being held in an assembled position by engaging portions of the face plate and the connector cover.

6. The low profile electrical connector assembly of claim 5 wherein the medial portions have weld pads, and the conductive cores of the insulated electric cables are welded to the respective weld pads of the terminals.

7. The low profile electrical connector assembly of claim 6 wherein the contacts and the medial portions of the terminals are substantially co-planar.

8. The low profile electrical connector assembly of claim 7 wherein the contacts are contact blades.

9. The low profile electrical connector assembly of claim 8 wherein the contact blades are shaped like tuning forks that have a slot.

10. The low profile electrical connector assembly of claim 8 wherein the contact blades are a solid blade or square pin designed to mate with a female terminal.

11. The low profile electrical connector assembly of claim 7 wherein the engaging portions include a lock notch of the face plate that cooperates with a lock nib of the connector base.

12. The low profile electrical connector assembly of claim 6 wherein the conductive cores of the insulated electric cables are welded to the respective weld pads of the terminals without removing the insulation jackets and wherein the attachment portions tightly gripping the insulation jackets are thinner than the contacts and the medial portions of the terminals.

* * * * *